US005121967A

United States Patent [19]

Rogers

[11] Patent Number: 5,121,967

[45] Date of Patent: Jun. 16, 1992

[54] ROCKER RECLINER

[76] Inventor: Walter C. Rogers, P.O. Box 728, Denton, N.C. 27239-0728

[21] Appl. No.: 544,919

[22] Filed: Jun. 28, 1990

[51] Int. Cl.[5] ..... A47C 3/02

[52] U.S. Cl. ..... 297/270; 297/DIG. 7

[58] Field of Search ..... 297/270, DIG. 7, 261, 297/85, 80

[56] References Cited

U.S. PATENT DOCUMENTS

| | | | |
|---|---|---|---|
| 3,243,226 | 3/1966 | Katz | 297/DIG. 7 |
| 3,352,601 | 11/1967 | Cycowicz | 297/270 X |
| 3,767,257 | 10/1973 | Rogers, Jr. et al. | 297/270 |
| 3,869,170 | 3/1975 | James et al. | 297/270 |
| 3,912,327 | 10/1975 | Johnson | 297/270 |
| 4,437,701 | 3/1984 | Mizelle | 297/DIG. 7 |
| 4,601,513 | 7/1986 | Pine | 297/DIG. 7 |

*Primary Examiner*—Peter A. Aschenbrenner
*Attorney, Agent, or Firm*—William E. Mouzavires

[57] ABSTRACT

A rocker recliner having carrier scissor links mounting the seat and backrest assembly to the rocker cams through a pair of front and rear mounting links mounted on the cam. Rocking motion is prevented when the chair is in T.V. and advanced reclining positions by a linkage pivoted to the base, rocking cam and the rear mounting link. This rock-blocking linkage idles when the chair is rocking but becomes unified to prevent rocking of the cam when the chair moves into T.V. position.

3 Claims, 3 Drawing Sheets

ROCKER RECLINER

BACKGROUND OF INVENTION

In one type of rocker recliner, rocking motion is achieved through a pair of cams typically made from wooden members having lower convexly arcuate surfaces which engage against a base and of course are rockable on the base. A linkage system is mounted to and between the rocker cams and the seat of the chair with the links positioned in vertical planes located laterally outwardly of the planes of the rocker cams. The links of these prior art systems are stacked one after the other outwardly of the cams and due to their stacking, the distance between the cams at times is not sufficient for effective stability. Moreover, the stacked links are subject to bending forces due to the distance between the inner and outermost stacked links. This again causes instability of the chair particularly when the occupant leans to one side or the other side of the chair and can further lead to damaging the links.

OBJECTS OF THE PRESENT INVENTION

The present invention generally relates to rocker recliner chairs, sometimes called rocker recliners, and more specifically to a novel and improved rocker recliner of the type having a normal or generally upright position during which the occupant may rock the chair, a T.V. position in which a footrest is extended and rocking motion is prevented, and one or more advanced reclining positions during which rocking of the chair continues to be prevented. One of the objects of the present invention is to overcome the problem noted above.

Another object of the present invention is to provide such a rocker recliner having a novel and improved linkage system which will achieve the necessary support of the seat and backrest relative to the base while allowing reduction of the material of the links thereby decreasing cost of manufacture. Included herein is the provision of such a linkage system which allows the lateral distance between the rocking cams to be increased in order to increase stability of the chair.

Another object of the present invention is to provide such a recliner chair having a novel and improved mechanism for preventing rocking of the seat relative to the base when the chair is in T.V. or advanced reclining positions.

SUMMARY OF INVENTION

To summarize one preferred embodiment of the present invention, it includes a pair of scissor links which mount the seat and backrest of the rocker recliner to the rocker cams through a pair of mounting links. The rocker cams are of course mounted on the fixed base of the chair. T.V. position of the chair is achieved by an actuator which drives the footrest to T.V. position. The actuator may be handle operated as in the preferred embodiment, however other types of actuators may be employed. In conjunction with the aforementioned scissor links, a novel linkage assembly is provided preventing rocking movement of the seat and backrest relative to the base when the seat is moved into T.V. position and reclining positions beyond T.V. position. This assembly includes three links which during rocking motion of the chair in the upright position, merely idle in their movement relative to the seat cams and the base. However when the seat reaches T.V. position, the three links become unified to prevent rocking motion of the seat relative to the base. These links continue to be unified when moving into advanced reclining positions to continue to prevent rocking movement of the seat relative to the base.

DRAWINGS

Other objects and advantages of the present invention will become apparent from the following detailed description taken in conjunction with the drawings in which.

DETAILED DESCRIPTION

Figure 1:
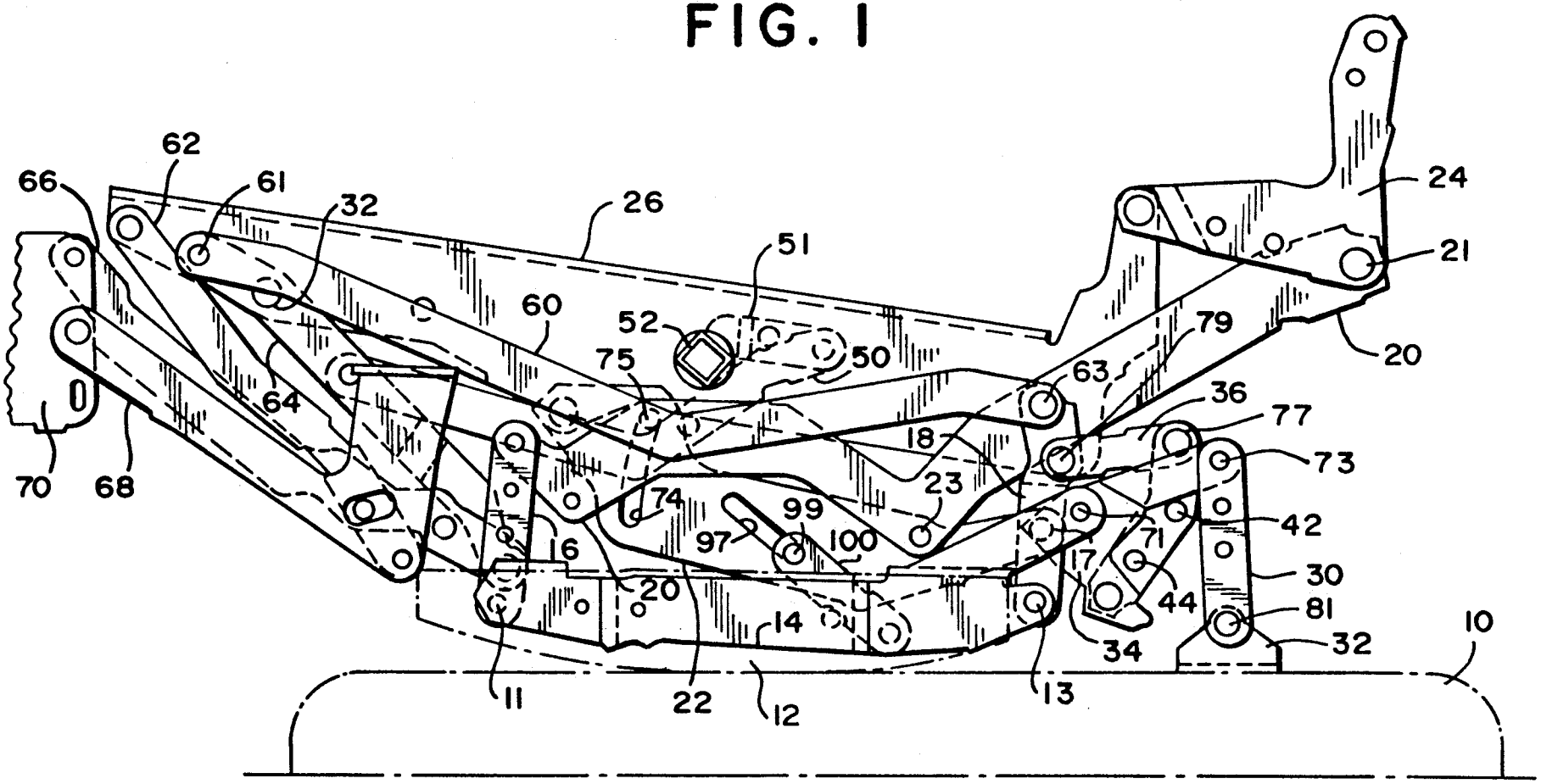
FIG. 1 is a side elevational view of a linkage mechanism looking from the inside to the outside of the chair shown in the closed or normal position of the chair, it being understood that upholstery and other frame portions of the chair are removed for clarity.
Figure 2:
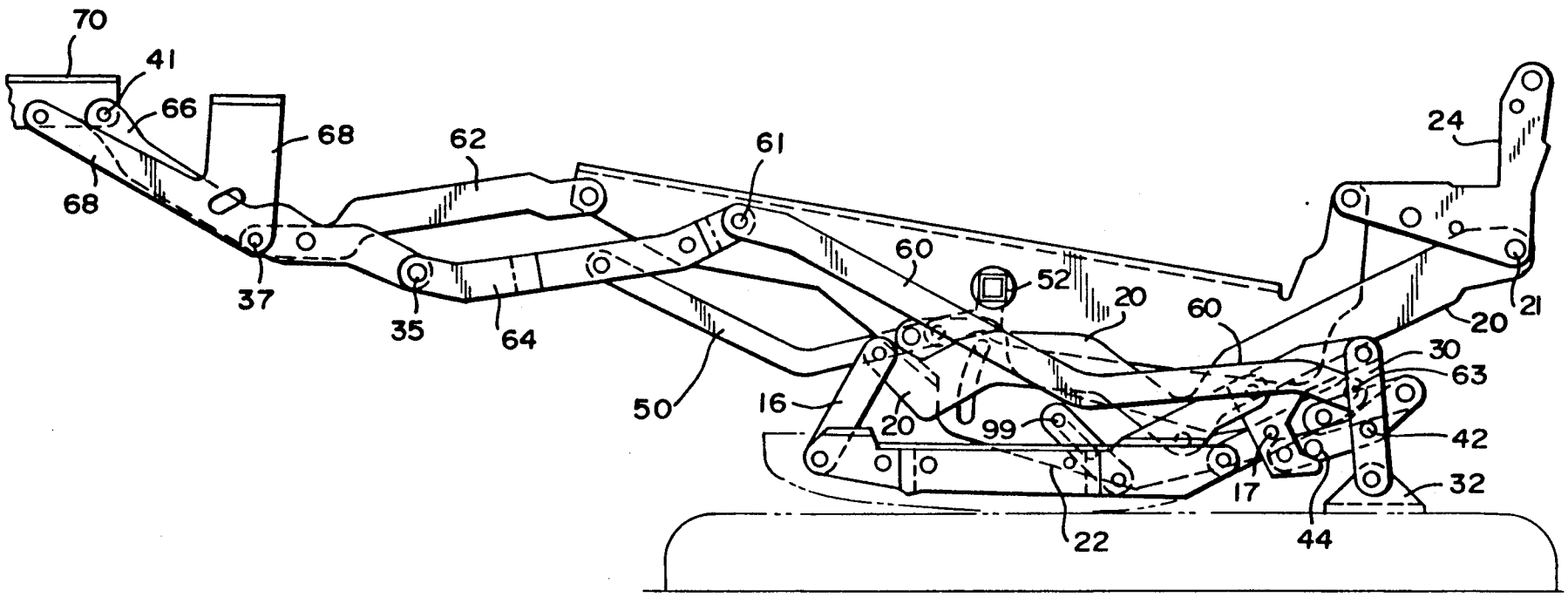
FIG. 2 is a view generally similar to FIG. 1 except that the linkage system is shown in the T.V. position in which the footrest is extended.
Figure 3:
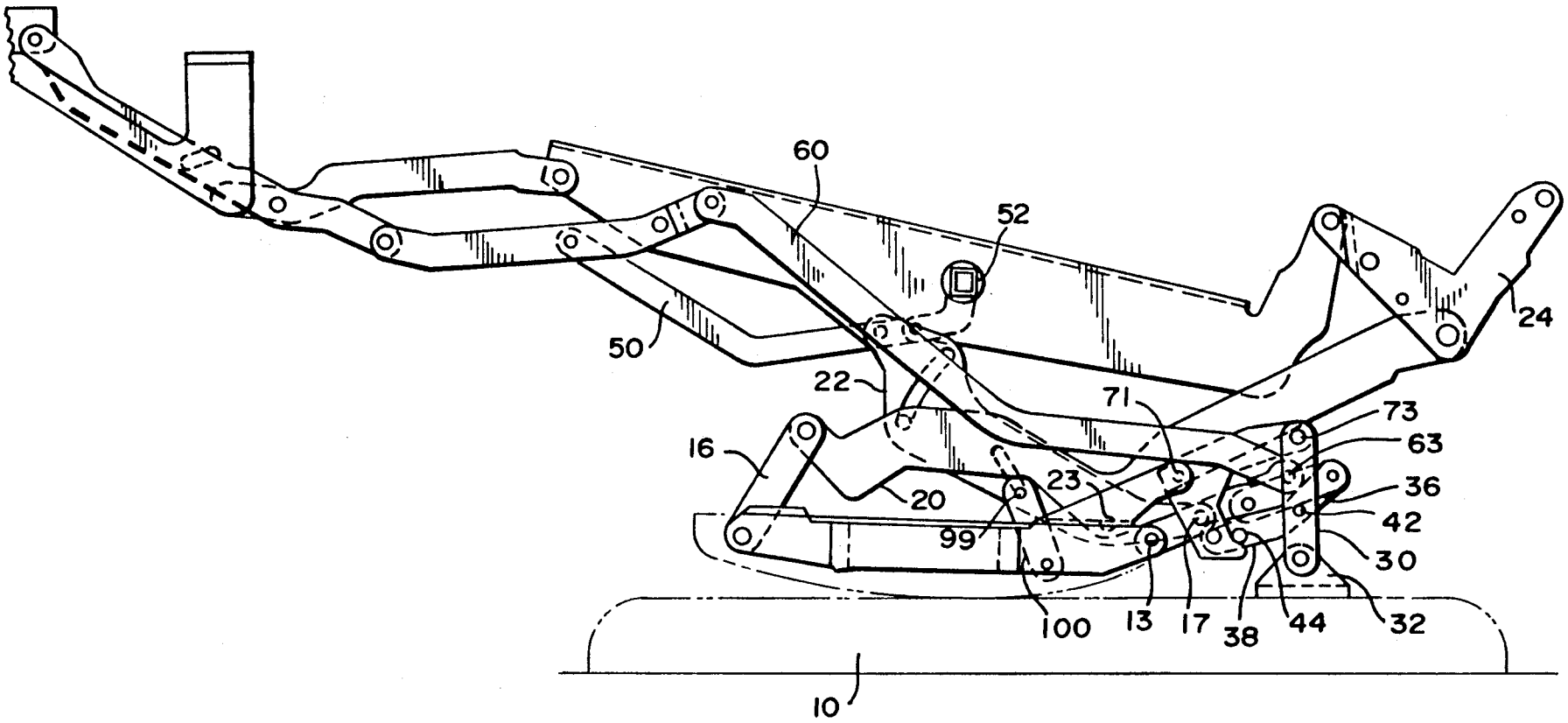
FIG. 3 is a view generally similar to FIG. 2 but showing the linkage system in an advanced or fully reclined position.

Referring now to the drawings in detail, there is shown for illustrative purposes only a rocker recliner incorporating a preferred embodiment of the present invention. The rocker recliner includes a base 10 typically made from a horizontal pieces of wood having a rectangular or circular or any other desired configuration and adapted to rest on the floor. A pair of rocking cams generally designated 12 (only one shown in the drawing) are mounted on the base 10 for rocking movement, the cams having a convex lower surface which is engageable with the base during rocking. As the linkage systems on the opposite sides of the chair are mirror images of each other except for the handle actuator which will be described, a description of the linkage system on only one side of the chair should suffice. In the drawings of FIGS. 1 through 3, the linkage shown is on the right hand side of the chair as would exist relative to an occupant and as seen from the inside of the chair looking outwardly.

Fixed to the cam 12 is a mounting link 14 to which is pivotally mounted a pair of front and rear mounting links 16 and 18 respectively. The seat and backrest of the chair are mounted to the front and rear mounting links 16 and 18 by means of a pair of carrier links 20 and 22 which open and close relative to each other like scissors and therefore may be termed "carrier scissor links". Carrier link 20 is mounted to the front mounting link 16 by means of pivot 15 while carrier link 22 is mounted to rear mounting link 18 through pivot 17. Carrier link 22 is pivoted to seat link 26 by pivot 19 while carrier link 20 is pivoted by pivot 21 to a backrest link 24. The latter is pivotally connected by pivot 25 to seat link 26. Seat link 26 is of course fixed to the side rail of a seat frame while backrest link 24 is fixed to the side rail of a backrest frame, the frames may be typically made from wood with rectangular or other configurations. For example, see the inventor's U.S. Pat. No. 4,519,647 whose disclosure is hereby incorporated into the present application for that purpose. Carrier links 20 and 22 are pivoted to each other at pivot 23 to pivot relative to each other when the chair moves beyond the T.V. position shown in FIG. 2 to an advanced reclining position shown in FIG. 3.

The footrest mechanism of the chair includes a footrest linkage which includes a pair of footrest mounting links 62 and 64 pivoted at 31 and 32 to the seat link 26 at positions spaced from each other as shown in FIG. 2 for movement between a retracted position shown in FIG. 1 to an extended (T.V.) position shown in FIG. 2. Footrest links 62, 64 are pivoted to a second pair of footrest links 66 and 68 at pivots 35 and 37. The latter links are pivoted to a footrest frame link 70 at pivots 39 and 41. Footrest frame 70 is adapted to be covered with upholstery in well known manner. In addition to the footrest mounting frame 70, a secondary or an intermediate footrest not shown is provided on footrest link 68 at the flange 69 shown in FIG. 2. Any other suitable footrest assembly may be utilized instead of that shown in the drawings.

In the preferred embodiment, the footrest linkage is actuated from a retracted position shown in FIG. 1 to an extended position shown in FIG. 2 by means of a handle actuator fixed to a shaft 52 mounted in the seat link 26. A crank 51 is fixed to the shaft 52 and is connected at pivot 41 to an actuator link 50 to drive the same from the retracted position shown in FIG. 1 to the extended position shown in FIG. 2. Actuator link 50 is pivotally connected at pivot 45 to footrest link 64 to drive the latter between the retracted and extended positions.

During movement of the chair from the closed position shown in FIG. 1 to the T.V. position shown in FIG. 2, the front and rear mounting links 16 and 18 are pivoted clockwise as shown in FIGS. 1 and 2. The latter is accomplished by means of a control link 60 having one end pivotally connected at pivot 61 to a crank portion of footrest mounting link 64 and having an opposite end pivotally connected by pivot 63 to the upper end of rear mounting link 18. It will thus be seen that when the chair moves to T.V. position, the control link 60 will drive rear mounting link 18 clockwise as viewed in the drawings from the generally upright position shown in FIG. 1 to the rearwardly inclined position shown in FIG. 2.

Once the chair reaches the T.V. position shown in FIG. 2, a novel assembly becomes effective to prevent rocking of the seat relative to the base 10. Referring to FIG. 1, in the preferred embodiment shown, this assembly includes what will be termed an idler link 34 having a pair of arms and being pivotally mounted to a rear end portion of the mounting link 14 at pivot 71. The arms of idler link 34 extend generally rearwardly although they are respectively pivotally connected to second and third idler links 30 and 38 by pivots 73 and 75. Idler link 38 is pivoted at 77 to another idler link 36 which in turn is pivotally mounted by pivot 79 to an intermediate portion of the rear mounting link 18. Idler link 30 has one end pivotally mounted to the base 10 by means of a mounting bracket 32 and pivot 81.

During rocking of the chair when in the normal upright position shown in FIG. 1, it will be seen that the idler links will merely idle in pivoting motion or rotation about pivot 71 relative to the rocking cam assembly and of course the seat and the base, thus allowing the rocking action to proceed as desired. However, when the chair is moved into T.V. position shown in FIG. 2, a pair of stops 42 and 44 will come into play to prevent further rocking of the seat relative to the base. In the preferred embodiment, stops 42 and 44 are pins fixed to idler link 38 to be engageable with links 36 and 34 as best shown in FIG. 2. Such engagement of the stops in effect unifies idler links 34, 36 and 38 to prevent rocking of the cams relative to the base.

In order to advance the chair from T.V. into any reclining position, the occupant merely exerts back pressure on the backrest which will cause the backrest link 24 to pivot in a clockwise direction as viewed in the drawings to raise the seat link 26 and move it rearwardly relative to the scissor links which will open relative to each other by pivoting action about pivot 23. During such positioning of the chair, the rock-blocking links 34, 36, 38 will remain in their unified position to prevent rocking action. In order to return to T.V. position, the occupant merely removes pressure from the backrest, and to return to the upright position, the occupant merely places pressure on the footrest to retract the same with the legs.

In order to insure that the seat does not go into any advanced reclining position during rocking motion of the chair while in the upright position, a sequencing mechanism is provided which in the shown embodiment includes a slot 97 in the carrier link 22 and a pin 99 received in slot 97 and fixed to a sequencing link 100 which is pivoted to the cam mounting link 14. In the closed or upright position shown in FIG. 1, the pin 99 will be at the bottom of slot 97 to prevent movement of the chair into any advanced reclining positions. However when the chair is in the T.V. position pin 99 will be in the top of the slot 97 thus allowing the chair to be moved into advanced reclining position during which sequencing link 100 will move to replace the pin 99 in the lower portion of the slot.

In the preferred embodiment, in order to prevent side sway between the scissor links 20 and 22, a slot 74 is provided in the scissor link 22 to receive a pin 75 fixed to the other scissor link 20 and having an end cap to thus maintain the scissor links in the proper position relative to each other.

It should be understood that while a preferred embodiment of the invention has been shown and described, the scope of the invention is indicated by the appended claims below.

What is claimed is:

1. A rocker recliner chair comprising in combination a base adapted to be mounted on a horizontal surface, a rocker cam mounted on the base for rocking movement, a seat and backrest, a linkage system mounting the seat and backrest to the rocker cam and including a pair of scissor links pivoted to each other for movement between a closed position when the chair is in T.V. position and an open position when the chair is in advanced reclining position, and a linkage assembly for preventing rocking motion of the cam relative to the base when the chair is in T.V. position, the assembly comprising a first link pivotally mounted to the rocking cam, said first link having a pair of arms and being pivotally mounted to the rocker cam at a location between said arms, one arm being connected to said base, a second link pivotally linked to the other arm and a third link pivotally connected to the second link and being pivotally connected to a scissor link and wherein said second link has a pair of stops engageable with one of the arms of the first link and the third link when the chair is in the T.V. position.

2. A rocker recliner having a base, a seat and backrest, a linkage system mounting the seat and backrest to the base including a rocker cam, front and rear mounting links mounted on the rocker cam, a pair of scissor links mounted on the front and rear mounting links to mount the seat and backrest relative to the rocker cam, a footrest, means for actuating the footrest between a retracted position and an extended position; the improvement comprising a rock-blocking assembly for preventing rocking movement of the seat relative to the base when the seat is moved to T.V. position, the assembly including a first link pivotally mounted relative to the rocker cam and having a first arm pivotally connected to the base, a second link pivotally connected to a second arm of the first link and a third link pivotally connected to the second link and pivotally connected to the rear mounting link, said first, second and third links being movable relative to the rocker cam during rocking of the seat relative to the base and being movable into a fixed position preventing rocking movement when the chair moves into T.V. position and wherein said third link is pivotally connected to the rear mounting link by a pivot whose position is fixed relative to said second arm of said first link.

3. The rocker recliner defined in claim 2 wherein said second link has a pair of stops engageable with one of said arms and said third link when the chair is in the T.V. position.

* * * * *